US012345490B2

(12) United States Patent
Kunz

(10) Patent No.: US 12,345,490 B2
(45) Date of Patent: Jul. 1, 2025

(54) EXTENDED LIFE COMPOSITE MATRIX-WRAPPED LIGHTWEIGHT FIREARM BARREL

(71) Applicant: Brown Dog Intellectual Properties, Exton, PA (US)

(72) Inventor: Joshua M. Kunz, Exton, PA (US)

(73) Assignee: Brown Dog Intellectual Properties, Exton, PA (US)

( * ) Notice: Subject to any disclaimer, the term of this patent is extended or adjusted under 35 U.S.C. 154(b) by 0 days.

(21) Appl. No.: 17/939,066

(22) Filed: Sep. 7, 2022

(65) Prior Publication Data

US 2023/0074469 A1 Mar. 9, 2023

Related U.S. Application Data

(60) Provisional application No. 63/241,898, filed on Sep. 8, 2021.

(51) Int. Cl.
*F41A 21/02* (2006.01)
*F41A 21/22* (2006.01)

(52) U.S. Cl.
CPC ..... *F41A 21/02* (2013.01); *F41A 21/22* (2013.01)

(58) Field of Classification Search
CPC ..... F41A 21/02; F41A 21/44
See application file for complete search history.

(56) References Cited

U.S. PATENT DOCUMENTS 2,137,259 A * 11/1938 Boak ..... F41A 21/02 89/14.05
2,780,019 A * 2/1957 Sullivan ..... F41A 21/22 89/14.05
2,792,657 A * 5/1957 Slowter ..... F41A 21/22 42/76.02
2,799,959 A * 7/1957 Osborn ..... F41A 21/22 42/76.02
2,845,741 A * 8/1958 Day ..... F41A 21/02 42/76.01
2,847,786 A * 8/1958 Day ..... F41A 21/02 42/76.01
3,004,361 A * 10/1961 Hammer ..... F41A 21/02 42/76.02
3,209,461 A * 10/1965 Wilson ..... G01B 3/38 33/506
3,742,640 A * 7/1973 Thomsen ..... F41A 21/02 42/76.01
H82 H * 7/1986 Dittrich ..... F41A 21/02 138/155
4,669,212 A * 6/1987 Jackson ..... F41A 21/20 42/76.02

(Continued)

*Primary Examiner* — Derrick R Morgan
(74) *Attorney, Agent, or Firm* — Armstrong Teasdale LLP

(57) ABSTRACT

A firearm barrel and a method for manufacturing the same are disclosed. In some embodiments, a barrel for a firearm may be provided. The barrel may comprise a chamber, an entire geometry of which is formed to a final depth. After providing the barrel with the entire geometry of the chamber being formed to the final depth, a material modification process that modifies one or more properties of the barrel may be performed. After performing the material modification process, a composite matrix wrapping that surrounds an outer circumference of the barrel over a length of the barrel may be applied.

18 Claims, 7 Drawing Sheets

(56) References Cited

U.S. PATENT DOCUMENTS 4,685,236 A * 8/1987 May ..... F41A 21/02 42/76.02
4,756,677 A * 7/1988 Hribernik ..... F41A 21/02 419/48
5,410,796 A * 5/1995 Weeks, Jr. ..... F41A 21/02 29/419.1
6,189,431 B1 * 2/2001 Danner ..... F41A 21/02 42/76.02
6,817,132 B1 * 11/2004 Sirois ..... F41A 21/12 42/76.01
7,191,558 B1 * 3/2007 Conroy ..... F41A 21/22 89/14.05
7,934,332 B2 * 5/2011 Briggs ..... F41A 21/02 89/14.05
8,302,341 B2 * 11/2012 Fonte ..... F41A 21/20 89/14.7
9,372,038 B1 * 6/2016 Sylvester ..... F41A 3/26
9,638,484 B1 * 5/2017 Friend ..... F41A 35/06
9,695,489 B1 * 7/2017 Wright ..... C22C 27/06
10,001,337 B2 * 6/2018 Curliss ..... F41A 21/20
10,228,209 B2 * 3/2019 Newman ..... F41A 21/02
10,240,882 B1 * 3/2019 Hoffman ..... F41A 21/12
11,079,194 B1 * 8/2021 Sinnema ..... F41A 21/02
2004/0216350 A1 * 11/2004 Huston ..... F41A 21/02 42/76.1
2004/0244257 A1 * 12/2004 Degerness ..... F41A 21/02 42/76.02
2007/0256345 A1 * 11/2007 Hall ..... F41A 21/02 123/193.2
2007/0261286 A1 * 11/2007 Briggs ..... F41A 21/04 42/76.02
2007/0261587 A1 * 11/2007 Chung ..... F42B 5/313 102/466
2008/0120889 A1 * 5/2008 Bose ..... F41A 21/20 42/76.02
2011/0011253 A1 * 1/2011 Fonte ..... B21J 5/00 72/370.14
2011/0173864 A1 * 7/2011 Christensen ..... F41A 21/02 42/78
2012/0110885 A1 * 5/2012 Pelin ..... B21H 1/18 72/77
2012/0227302 A1 * 9/2012 Fonte ..... C22C 19/05 42/78
2013/0055612 A1 * 3/2013 Fonte ..... B21J 5/00 72/364
2015/0247693 A1 * 9/2015 Fonte ..... F41A 21/04 89/14.3
2016/0030989 A1 * 2/2016 Pichler ..... F41A 21/12 42/76.1
2016/0116251 A1 * 4/2016 Mather ..... F41C 23/16 42/71.01
2016/0363402 A1 * 12/2016 Mogle ..... F41A 21/02
2017/0205172 A1 * 7/2017 Curliss ..... F41A 21/16
2017/0241723 A1 * 8/2017 Schenker ..... F41A 3/66
2018/0023913 A1 * 1/2018 Newman ..... F41A 21/04 42/76.1
2019/0017176 A1 * 1/2019 Deshpande ..... C23C 10/28
2020/0408477 A1 * 12/2020 Glisovic ..... C22C 29/065
2022/0316836 A1 * 10/2022 Hammel ..... F41A 21/10
2022/0390201 A1 * 12/2022 Boretto ..... F41A 21/02
2023/0074469 A1 * 3/2023 Kunz ..... F41A 21/22
2023/0243613 A1 * 8/2023 Ewing, Jr. ..... B21D 51/20 42/76.01

* cited by examiner

EXTENDED LIFE COMPOSITE MATRIX-WRAPPED LIGHTWEIGHT FIREARM BARREL

CROSS-REFERENCE TO RELATED APPLICATION

This application claims the benefit of priority to U.S. Provisional Patent Application No. 63/241,898, filed on Sep. 8, 2021 in the United States Patent and Trademark Office, the entire contents of which are incorporate herein by reference.

TECHNICAL FIELD

The present disclosure relates generally to firearm barrels, and more particularly, to firearm barrels formed using a combination of material modification and composite matrix wrapping for extended life and weight reduction.

BACKGROUND

The barrel of a firearm is known to be a critical contributing factor to firearm performance. The shooting accuracy of a newly manufactured barrel is typically reliable and consistent. Repeated firing can degrade the structural integrity of the barrel, however, and cause diminished performance over time. For this reason, firearm barrels have an approximate lifespan during which they can provide accurate and repeatable shot placement. Experienced shooters are well-aware of these limitations and are regularly seeking solutions to extend the lifespan of firearm barrels.

One such solution that has shown empirical success in the firearms industry is the application of a material modification process to the barrel. An example material modification process involves subjecting the barrel to a heat treatment operation. The heat treatment results in a hardening of the material of the barrel which in turn has a positive effect on the barrel's durability and longevity.

The application of a heat treatment may be achieved in various ways. In some cases, such as in the custom firearms industry, a barrel blank that has been machined to fit a barrel is delivered to a customer who then shoots the firearm for a pre-determined number of rounds, cleans all fouling out of the barrel interior, and eventually sends the used firearm back to the gunsmith for heat treatment processing. The gunsmith may send the barrel, often as part of a batch of barrels, to be processed, and upon return, the gunsmith sends the heat-treated barrel back to the customer who reassembles the firearm for use. In other cases, the customers themselves may handle the break-in period of the barrel and ship the barrel to a heat treatment facility for processing. In either case, the barrel is completely machined and fit to the action prior to heat treatment. No further machinery operations are performed to the barrel once it is sent away to heat treatment processing.

In yet another case, such as in the production firearms industry, the firearm barrel may be fully machined, ready for installation in a firearm, after which the barrel is batch-processed for heat treatment without any of the aforementioned break-in firing or additional cleaning. Upon return to the manufacturer (after the heat treatment operation), the hardened barrel is installed in a firearm and sent out to the customer through regular supply chain channels.

In addition to extending the barrel's lifespan, there has been an increasing desire for barrels made of lightweight materials. This is particularly true in the hunting community, where using a lightweight firearm can provide myriad benefits to the hunter. Manufacturers have employed a variety of techniques to trim weight from firearm barrels, such as applying a composite matrix wrapping to the barrel. Although the composite matrix-wrapping industry is active predominantly in the rifle market, the concept of composite matrices applies to several classifications of firearms.

Applying a composite matrix wrapping to a firearm barrel typically follows a multi-step process. For example, the process may begin with turning a steel bar into a rifled barrel blank. The barrel blank may then be contoured into the "core" of the barrel. After this step, the contoured blank may be wrapped with a composite matrix material such as carbon fiber to produce a carbon fiber-reinforced polymer (CFRP) blank, followed by cutting the receiver interface geometry and chamber into the blank. Alternatively, the receiver interface geometry and chamber may be cut first, after which the carbon fiber wrap is applied to the chambered blank. Once the barrel blank has been wrapped, the muzzle geometry may be cut, in addition to performing any post-machining steps desired by the manufacturer (e.g., exterior caliber markings, branding, etc.). The fully wrapped and machined barrel is finally ready for firing.

Both of the aforementioned techniques—material modification processes (e.g., heat treatment) for extending the useful lifespan of a barrel and composite matrix wrappings for reducing barrel weight—provide important advantages for firearm owners. Problematically though, heating the barrel to high temperatures can damage composite matrix wrappings. As such, heat treatment operations and composite matrix wrappings have been found to be incompatible with each other in practice, making it difficult to simultaneously extend the lifespan and reduce the weight of a given firearm barrel.

SUMMARY

The present disclosure provides for a lightweight firearm barrel with an extended useful lifespan and a method for manufacturing the same. As will be described in greater detail below, the disclosed firearm barrel may be manufactured so that the chamber of the barrel is fully cut prior to being processed by a heat treatment operation or other material modification process. A composite matrix wrapping may then be applied to the barrel after the material modification processing is complete.

According to embodiments of the present disclosure, a method for manufacturing a firearm barrel may include: providing a barrel for a firearm, the barrel comprising a chamber therein, wherein an entire geometry of the chamber is formed to a final depth; after providing the barrel with the entire geometry of the chamber being formed to the final depth, performing a material modification process that modifies one or more properties of the barrel; and after performing the material modification process, applying a composite matrix wrapping that surrounds an outer circumference of the barrel over a length of the barrel.

The material modification process may include a heat treatment that is applied to the barrel. The heat treatment may include a hot isostatic pressing process.

Alternatively, the material modification process may include a case hardening treatment that is applied to the barrel. The case hardening treatment may include a gas nitriding process.

Alternatively, the material modification process may include an oxide coating applied to the barrel.

The composite matrix wrapping may include carbon fiber reinforced polymer (CFRP).

The providing of the barrel may include: providing a barrel blank that comprises the barrel.

Furthermore, the providing of the barrel may include: processing the barrel so as to form the chamber in an interior portion of the barrel, wherein the entire geometry of the chamber is formed to the final depth during the processing and before the material modification process is performed.

The geometry of the chamber may include a plurality of chamber features including two or more of: a body of the chamber, a shoulder of the chamber, a neck of the chamber, a throat of the chamber, and a leade of the chamber.

Additionally, when the barrel is provided, the chamber may be formed over-deep so as to allow headspace in the barrel without processing the chamber.

The method may further include: processing the barrel so as to form a receiver interface onto a portion of an outer surface of the barrel, the receiver interface at least partially overlapping the chamber in a transverse direction. In such case, the barrel may be processed so as to form the receiver interface before the material modification process is performed. Alternatively, the barrel may be processed so as to form the receiver interface after the composite matrix wrapping is applied.

The method may further include: after applying the composite matrix wrapping, performing one or more additional processing operations to the barrel, wherein the one or more additional processing operations do not affect the geometry of the chamber which is formed to the final depth.

Furthermore, according to embodiments of the present disclosure, a firearm barrel may include: a barrel having a chamber formed therein, the chamber extending longitudinally through an interior portion of the barrel, and one or more properties of the barrel being modified by a material modification process that is performed on the barrel; and a composite matrix wrapping that surrounds an outer circumference of the barrel over a length of the barrel, wherein the composite matrix wrapping is applied to the barrel after the material modification process is performed, wherein an entire geometry of the chamber is formed to a final depth prior to the material modification process being performed.

The material modification process may include a heat treatment that is applied to the barrel.

Alternatively, the material modification process may include a case hardening treatment that is applied to the barrel.

Alternatively, the material modification process may include an oxide coating applied to the barrel.

The composite matrix wrapping may include carbon fiber reinforced polymer (CFRP).

BRIEF DESCRIPTION OF THE DRAWINGS

The embodiments herein may be better understood by referring to the following description in conjunction with the accompanying drawings in which like reference numerals indicate identically or functionally similar elements, of which.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. The term "coupled" denotes a physical relationship between two components whereby the components are either directly connected to one another or indirectly connected via one or more intermediary components.

Referring now to embodiments of the present disclosure, techniques are described herein to simultaneously extend the lifespan and reduce the weight of a firearm barrel. This may be accomplished by providing a barrel with a fully machined chamber—i.e., cut to its final depth—prior to a material modification process that modifies one or more properties of the barrel. The material modification process may include, for example, a heat treatment to heat the barrel until the material of the barrel hardens ("case hardening"), improving the barrel's useful longevity. Once the material modification process is complete, the barrel may then be wrapped with a composite matrix (e.g., CFRP) wrapping to reduce the barrel's weight. Various post-machining steps (e.g., cutting geometry of muzzle and/or breech, exterior markings, etc.) according to firearm specifications may be performed after the material modification processing and the composite matrix wrapping, without cutting further material away from the barrel chamber.

Figure 1:
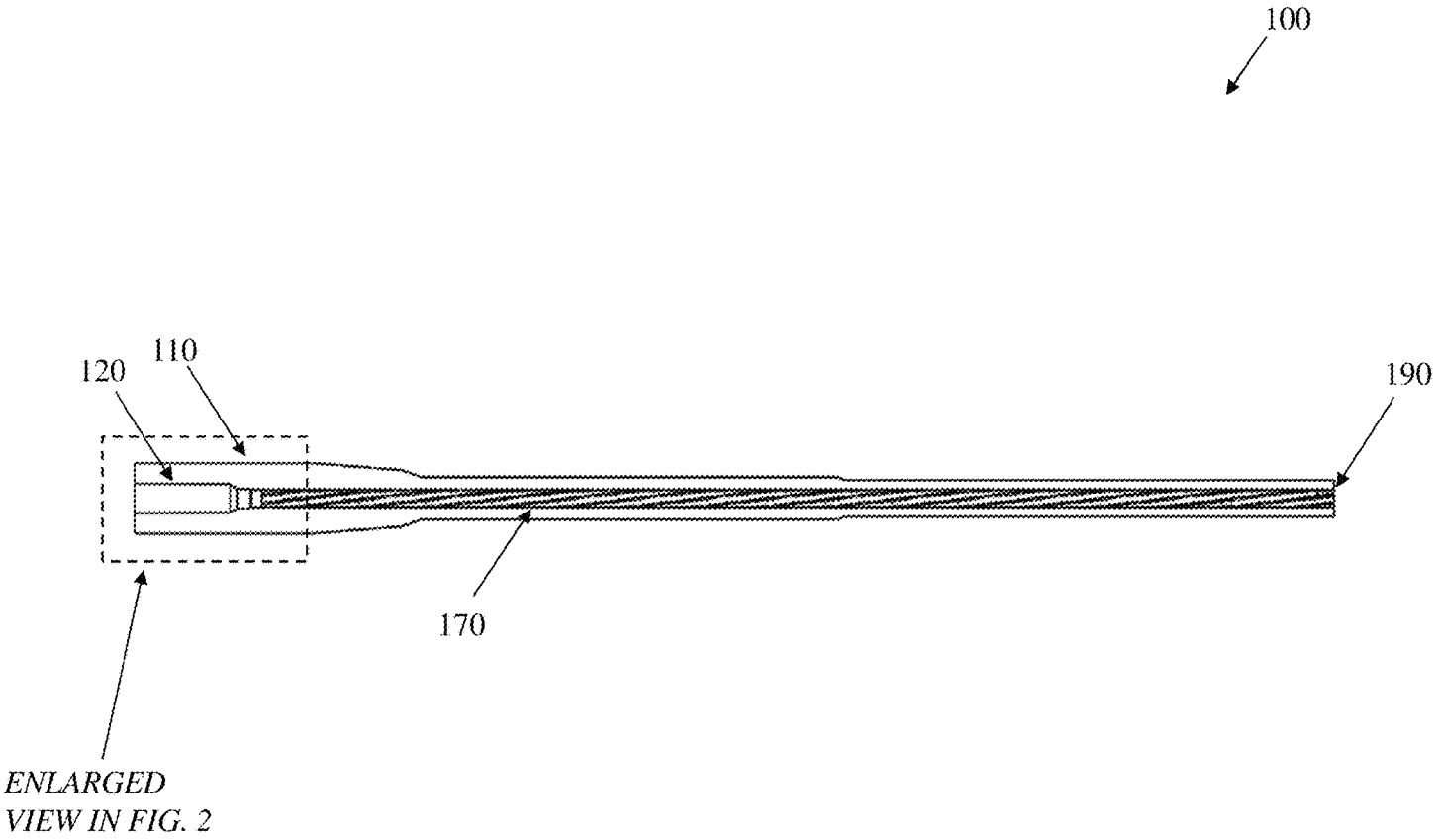
FIG. 1 illustrates a cross-sectional view of an exemplary firearm barrel according to embodiments of the present disclosure.
Figure 2:
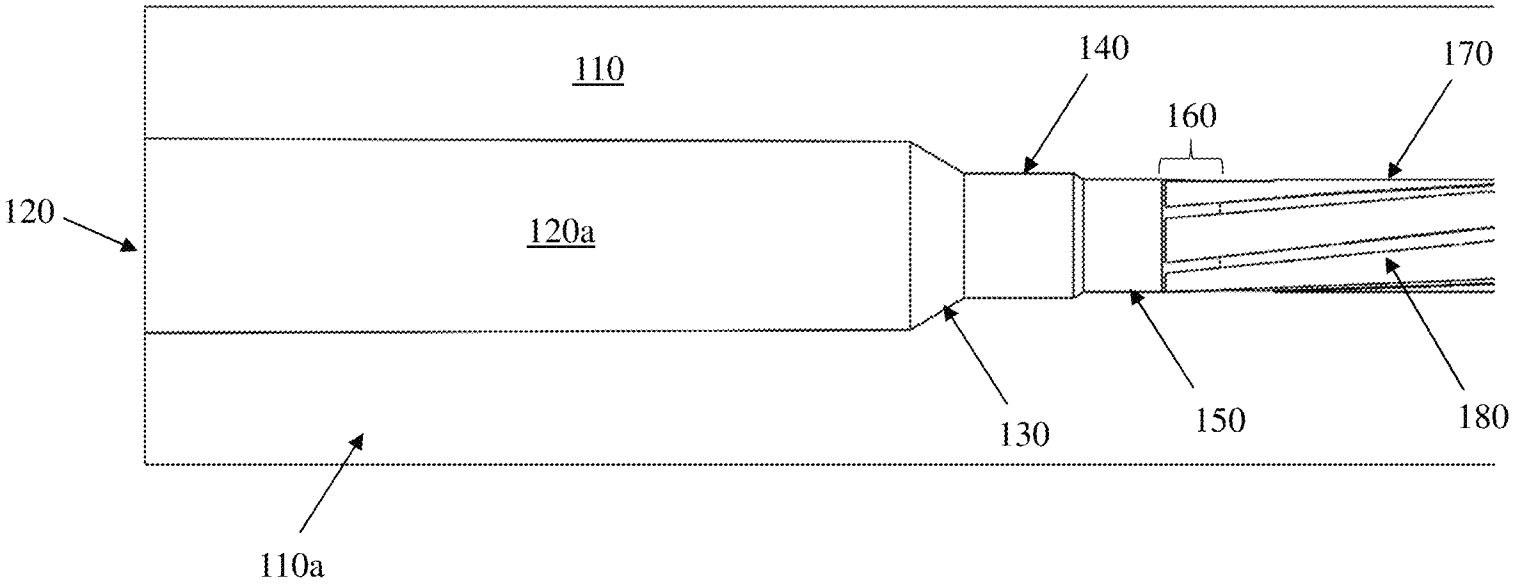
FIG. 2 illustrates an enlarged cross-sectional view showing chamber detail of the firearm barrel shown in FIG. 1.

FIG. 1 illustrates a cross-sectional view of an exemplary firearm barrel according to embodiments of the present disclosure, and FIG. 2 illustrates an enlarged cross-sectional view showing chamber detail of the firearm barrel shown in FIG. 1. As shown in FIGS. 1 and 2, a firearm barrel 100 with a barrel core 110 is provided. At this stage, the barrel 100 has not yet been subjected to a material modification process (e.g., heat treatment, case hardening treatment, oxide coating, etc.) or a composite matrix wrapping process (e.g., a carbon fiber winding or layup process), both of which will be described in further detail below. The barrel 100 may comprise a longitudinally extending tube, typically made of metal (e.g., steel, stainless steel, etc.), with a hollow interior capable of receiving a projectile (e.g., projectile 400) loaded into the chamber 120 at the rear end of barrel 100 and designed to enable the projectile to be propelled out of the muzzle 190 at the front end of the barrel 100 at a high velocity, as is well-understood in the art.

The barrel 100 may comprise a chamber 120 integrally formed within the barrel core 110. The chamber 120, as shown in close detail in FIG. 2, is a cavity in the rear end of the barrel 100. Structurally, the chamber 120 may consist of various sections, generally contoured to correspond to the shape of the projectile cartridge. Starting at the rear (breech) end of the barrel 100, the geometry of chamber 120 may include a chamber body 120*a*, which may be formed in the shank 110*a* portion of barrel core 110. The chamber body 120*a* may have the largest diameter of the various sections of chamber 120. Moving toward the front of barrel 100, chamber 120 may include a shoulder 130, formed with a tapered diameter from rear to front, transitioning to a neck 140, which is narrower in diameter than the chamber body 120*a*. The neck 140 may extend to a freebore (or throat) 150 followed by a leade 160. The freebore 150 and leade 160 may transition into a rifled bore 170 formed with spiraled rifling patterns (grooves and lands) 180. The bore 170 may extend internally through much of the length of barrel 100, terminating at the muzzle 190 where the projectile will exit the front of the barrel 100, as is well-understood in the art.

Importantly, the entire geometry of chamber 120, as illustrated in FIG. 2, may be formed to a final depth prior to a material modification process (e.g., heat treatment, case hardening treatment, oxide coating, etc.) or a composite matrix wrapping process (e.g., a carbon fiber winding or layup process) being applied to the barrel 100. This means that after the material modification and composite matrix wrapping processes are performed on the barrel 100, as described further below, no further material will be cut away from the aforementioned sections in the interior of the chamber 120, contrary to conventional barrel manufacturing.

In some embodiments, a barrel blank may be provided, whereby the barrel blank comprises the barrel 100. The barrel blank may be received from a barrel blank manufacturer, for example. The barrel blank may include a fully machined chamber that is formed to a final depth as described above. The material modification and composite matrix wrapping processes may then be performed on the barrel blank, followed by any exterior machining operations to become a finished rifle barrel as needed. Usage of barrel blanks in this manner may be of particular interest to the custom firearm industry. In other embodiments, rather than receiving a barrel blank with the chamber 120 already formed, the original equipment manufacturer (OEM) of the firearm may perform the processing of the barrel 100 so as to fully machine the chamber 120, such that the entire geometry of the chamber 120 formed to the final depth during the processing and before the material modification process is performed.

After forming the entire geometry of the chamber 120 to a final depth, a material modification process that modifies one or more properties of the barrel 100 may be performed. The material modification process may be applied to the barrel 100 so as to harden or stiffen the material of barrel 100, for example, thereby improving the longevity of the chamber throat 150, leade 160, and bore 170 during repeated firing of the firearm barrel. The material modification process is to be performed after the entire geometry of chamber 120 is formed to a final depth, as noted above, such that no additional machining of the chamber interior is performed after the material modification process is complete.

Various material modification processes may be utilized to modify one or more properties of the barrel 100 and thereby extend the barrel's useful life. For example, the material modification process may include a heat treatment that is applied to the barrel 100. The barrel 100 may be heated inside of a heat treat furnace (not shown). The heat produced by the furnace may treat the metal used to manufacture the barrel 100. The benefits of such heat treatment may include increasing the barrel's useful longevity, reducing stress fractures, and improving its overall strength, thus allowing the barrel 100 to better withstand the extreme conditions caused by repeated firing of the firearm. One specific example of a heat treatment includes a hot isostatic pressing process. Additional examples of the material modification process may include, for instance, case hardening treatments, such as a gas nitriding process, oxide coatings, carburizing, stress relieving, and the like, each of which is designed to transform a property of the barrel 100 (e.g., hardening or stiffening the metal used to make the barrel) in order to extend the barrel's useful life.

Performing the chamber cutting first, followed by the material modification process, in this order, can maintain the integrity of the surface hardness of chamber 120 that results from the material modification process. The freebore 150, leade 160, and bore 170, in particular, are known to demonstrate the highest propensity to wear over repeated firings. Likewise, the last 1-2 inches of the muzzle 190 prior to projectile exit are also known to show increased wear. Therefore, it is important that these sections of chamber 120 maintain the aforementioned benefits of material modification by forming the chamber 120 to its final depth prior to performing the material modification process.

After the material modification process is finished, a composite matrix wrapping may be applied to the barrel 100 to reduce the weight of the barrel, as well as improving the stiffness and strength of the barrel in some cases. The composite matrix wrapping may consist of, for example, carbon fiber reinforced polymer (CFRP) or other composite material.

Figure 3:
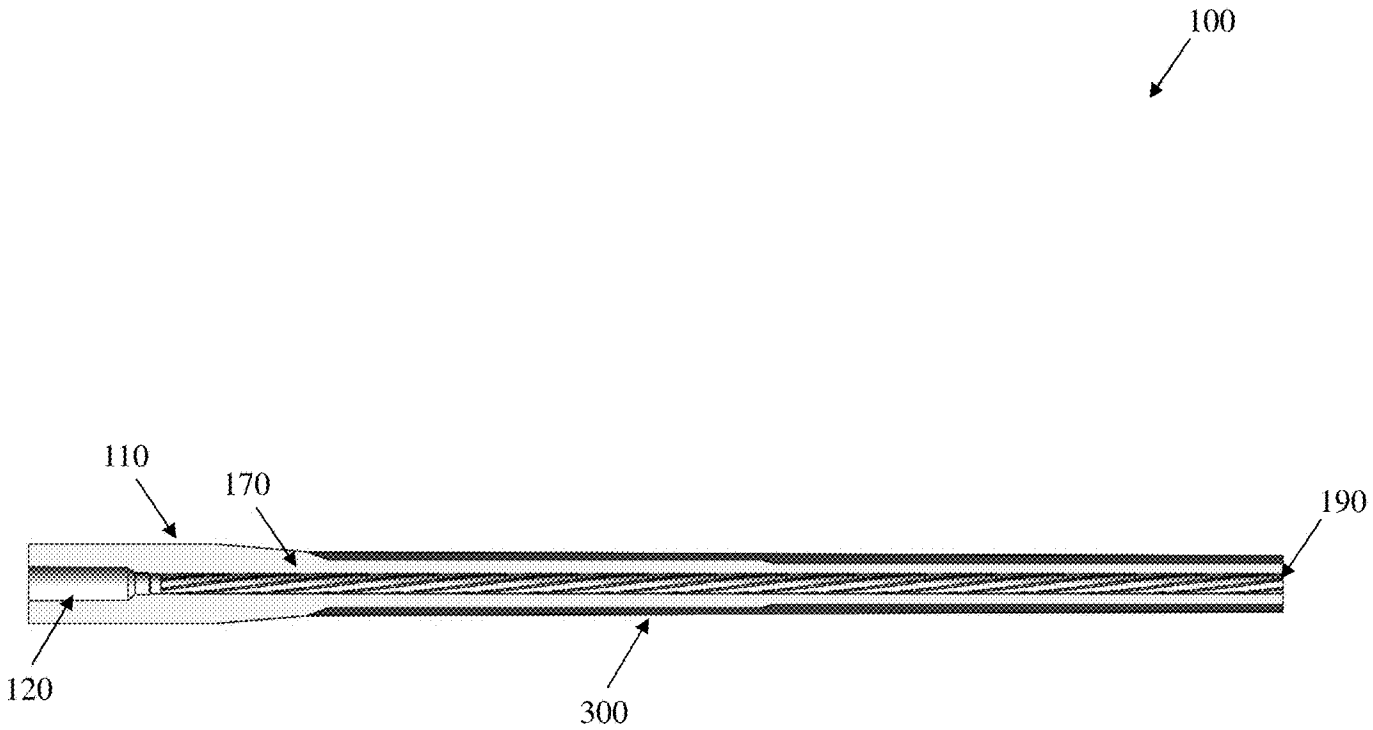
FIG. 3 illustrates a cross-sectional view of an exemplary post-material modification, composite matrix-wrapped firearm barrel according to embodiments of the present disclosure.

In detail, FIG. 3 illustrates a cross-sectional view of an exemplary post-material modification, composite matrix-wrapped firearm barrel according to embodiments of the present disclosure. As shown in FIG. 3, the barrel 100 may be wrapped using a composite matrix wrapping 300 that surrounds an outer circumference of the barrel 100 over a length of the barrel 100. In some embodiments, the composite matrix winding/layup process may be applied by machining the outer surface of the barrel 100 down to a significantly reduced profile, which reduces the overall weight of the barrel 100. The reduced contour barrel may then be wrapped with a composite matrix (e.g., carbon fiber) wrap. The resulting composite matrix-wrapped barrel 100, as shown in FIG. 3, is then significantly lighter than standard steel firearm barrels. It should be appreciated, however, that the above process is merely for the purpose of illustration, and that any other suitable technique for applying the composite matrix wrapping 300 to the barrel 100 may be utilized.

After applying the composite matrix wrapping 300, additional processing operations to the exterior of the barrel 100 may be performed as necessary. These additional processing operations may not affect the inner geometry of the chamber 120, however, which has already been formed to the final depth. For example, any operations required after heat treatment/material processing for ensuring the bond integrity between the composite matrix wrapping 300 and the barrel steel may be performed. These operations may include, but are not limited to:

- Chemical etching of the bonding region along the exterior surface of barrel 100;
- Additional machining or sanding/blasting operations of the exterior surface of barrel 100; or
- Other processing operations deemed necessary by the manufacturer to ensure bond line integrity between the composite matrix wrapping 300 and the metal (e.g., steel, stainless steel, etc.) core 110 of the barrel 100.

Once application of the composite matrix wrapping 300 is complete, as illustrated in FIG. 3, additional machining of the exterior of the barrel 100 may take place to prepare the barrel 100 for firing, as needed. For instance, the front (muzzle-side) of barrel 100 may be processed so as to cut the muzzle geometry. It is well-known that muzzle 190 of barrel 100 may suffer wear erratically due to epicyclic motion of the projectile 400 as it transitions from fully supported by the bore 170 to unsupported at muzzle exit. Various muzzle geometries are possible, but importantly the muzzle 190 will benefit from application of the material modification process (e.g., hardening), especially in the distal region of bullet travel, i.e., 1-2 inches prior to exiting the muzzle 190.

Figure 4:
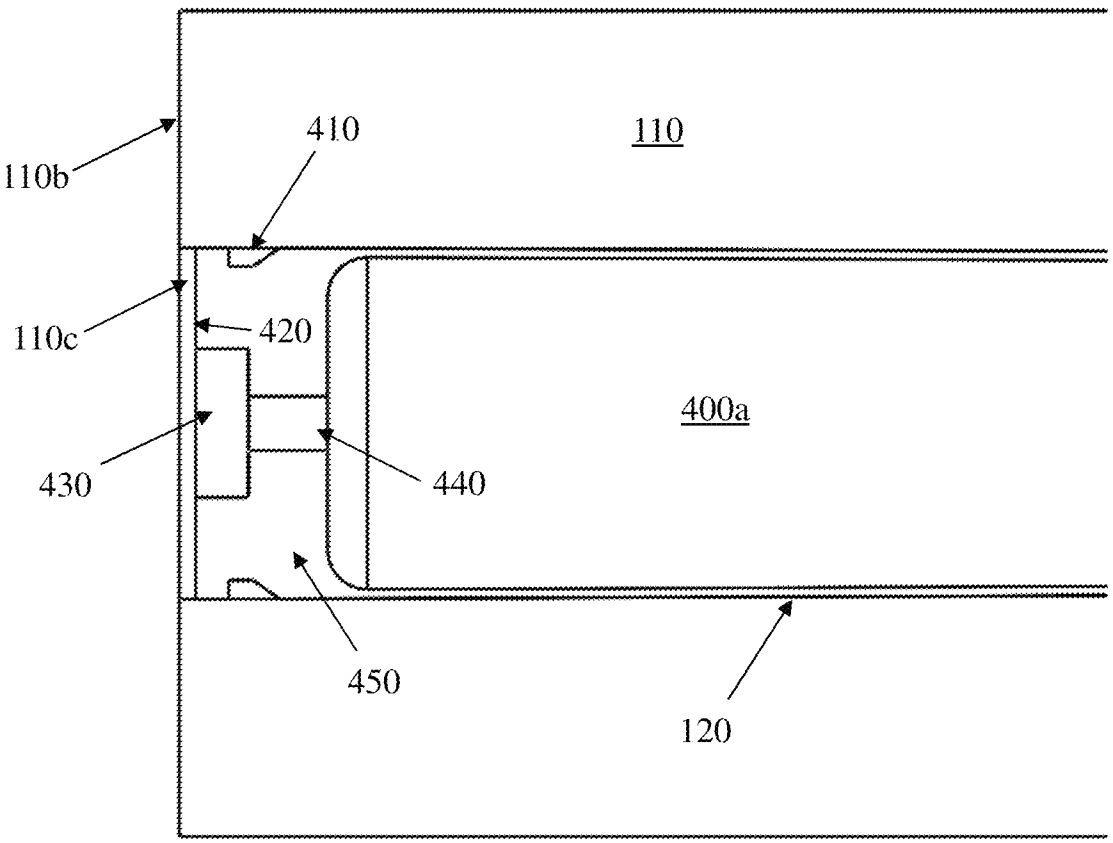
FIG. 4 illustrates an enlarged cross-sectional view of an exemplary firearm barrel with an over-deep chamber prior to a receiver interface being cut according to embodiments of the present disclosure.
Figure 5:
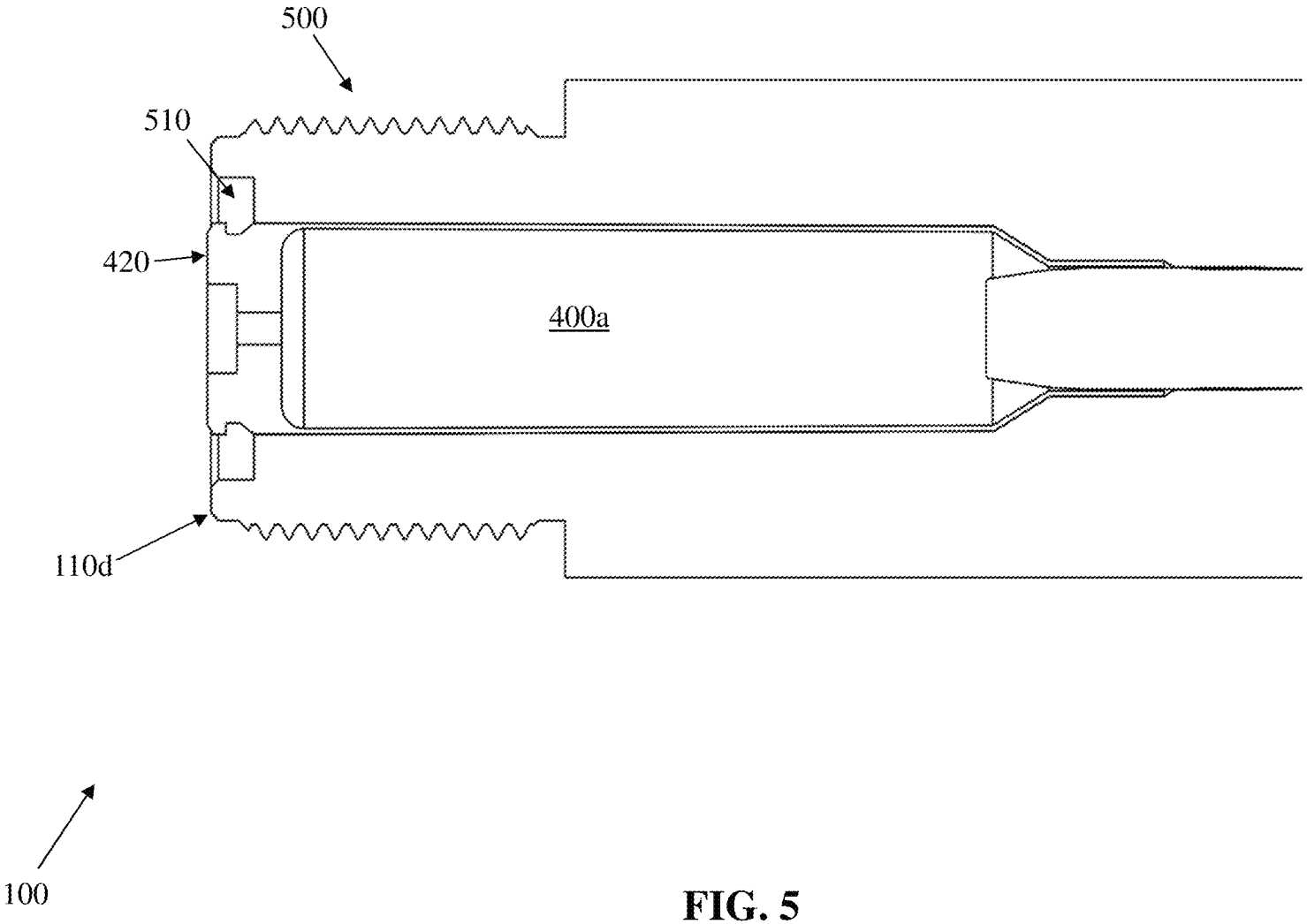
FIG. 5 illustrates an enlarged cross-sectional view of a fully machined receiver interface formed on the firearm barrel shown in FIG. 4.

Additionally, the rear (chamber-side) of barrel 100 may be processed so as to cut the receiver interface geometry for coupling the barrel 100 to the rifle assembly. Referring now to FIGS. 4 and 5, the chamber 120 of barrel 100 may be formed "over-deep" so as to allow headspace in the barrel 100 without additional post-processing of the chamber 120, and to facilitate the machining of a receiver interface 500 onto the exterior of barrel 100. Firstly, FIG. 4 illustrates a cross-sectional view of an exemplary firearm barrel with an over-deep chamber prior to a receiver interface being cut according to embodiments of the present disclosure. Forming the chamber 120 over-deep typically entails cutting deeper than nominally required so that once the material modification and composite matrix wrapping processes are complete, the barrel 100 can then undergo any additional exterior machining operations, such as adding the receiver interface geometry to the barrel 100, without cutting further material away from the freebore 150, leade 160, and bore 170 sections of the chamber 120, in order to preserve the hardening benefits imparted onto those sections by the material modification process.

In some embodiments, a projectile 400 with brass casing 400*a* may be inserted in the chamber 120 to prepare for precise machining of the receiver interface 500 on the exterior of barrel 100. Various structural markers of the brass casing 400*a* may aid in the machining of the receiver interface 500. For instance, brass casing 400*a* may include extractor groove 410, case head datum line 420, primer pocket 430, primer flash hole 440, case head web 450, etc., as would be understood by a person of ordinary skill in the art. The barrel core may include additional markers, such as breech face 110*b*, which is the breech face of core 110 after the chamber 120 is cut to at least flush or sub-flush, and sub-flash gap 110*c*, which is a gap inside the over-deep chamber 120 created between breech face 110*b* and case head datum line 420.

Using these markers, the geometry of receiver interface 500 can be machined onto a portion of the outer surface of barrel core 110. FIG. 5 illustrates a cross-sectional view of a fully machined receiver interface formed on the firearm barrel shown in FIG. 4. As shown in FIG. 5, after machining the receiver interface 500, breech face 110*b* in FIG. 4 may move as a result of the machining to 110*d* in FIG. 5, which is the breech face after the receiver interface 500 is machined into core 110. In some embodiments, the receiver interface geometry may optionally comprise a counterbore 510 in the breech face to extract the brass casing 400*a* of projectile 400, although not every installation will require this component. Notably, the relationship between the post-machining breech face 110*d* and case head datum line 420, which does not move during the transition from FIG. 4 to FIG. 5, may change due to the receiver interface 500 machining. The original interface relationship between the breech face 110*b* and case head datum line 420 in FIG. 4 shows that breech face 110*b* was further aft of case head datum line 420, whereas after machining the receiver interface 500, the case head datum line 420 has become further aft to the final/post-machining breech face 110*d*.

Figure 6:
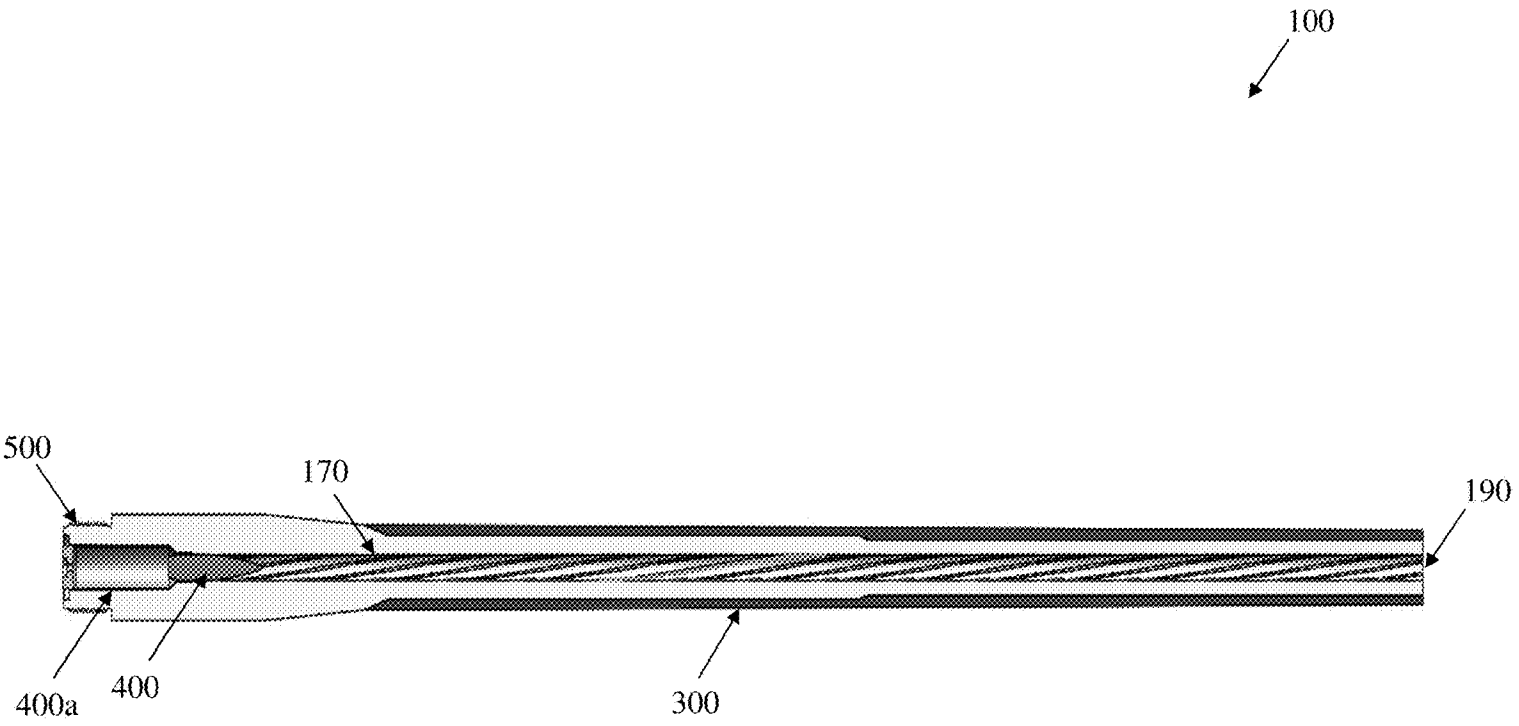
FIG. 6 illustrates a cross-sectional view of an exemplary firearm barrel with a machined receiver interface according to embodiments of the present disclosure.

The resulting firearm barrel 100—after (1) the chamber 120 has been formed to a final depth, (2) the material modification process has been performed, and (3) the composite matrix wrapping has been applied—is illustrated in FIG. 6 according to embodiments of the present disclosure. As shown, the barrel 100 has been processed so as to form the receiver interface 500, in accordance with the operations described above. The finished receiver interface 500 may at least partially overlap the chamber 120 in a transverse direction of barrel 100. In some embodiments, the receiver interface 500 may be machined after the material modification and composite matrix wrapping processes have been performed, as described above. In other embodiments, however, the receiver interface 500 may be machined at other stages of the aforementioned processing, such as before the material modification process, or after the material modification process and before the composite matrix wrapping, or even simultaneous with the formation of the chamber 120 within the core 110. Importantly, machining the receiver interface 500 does not impact the benefits conferred onto the barrel 100 by the material modification process or the composite matrix wrapping, so long as the chamber 120 is cut to final depth prior to the material modification process.

Figure 7:
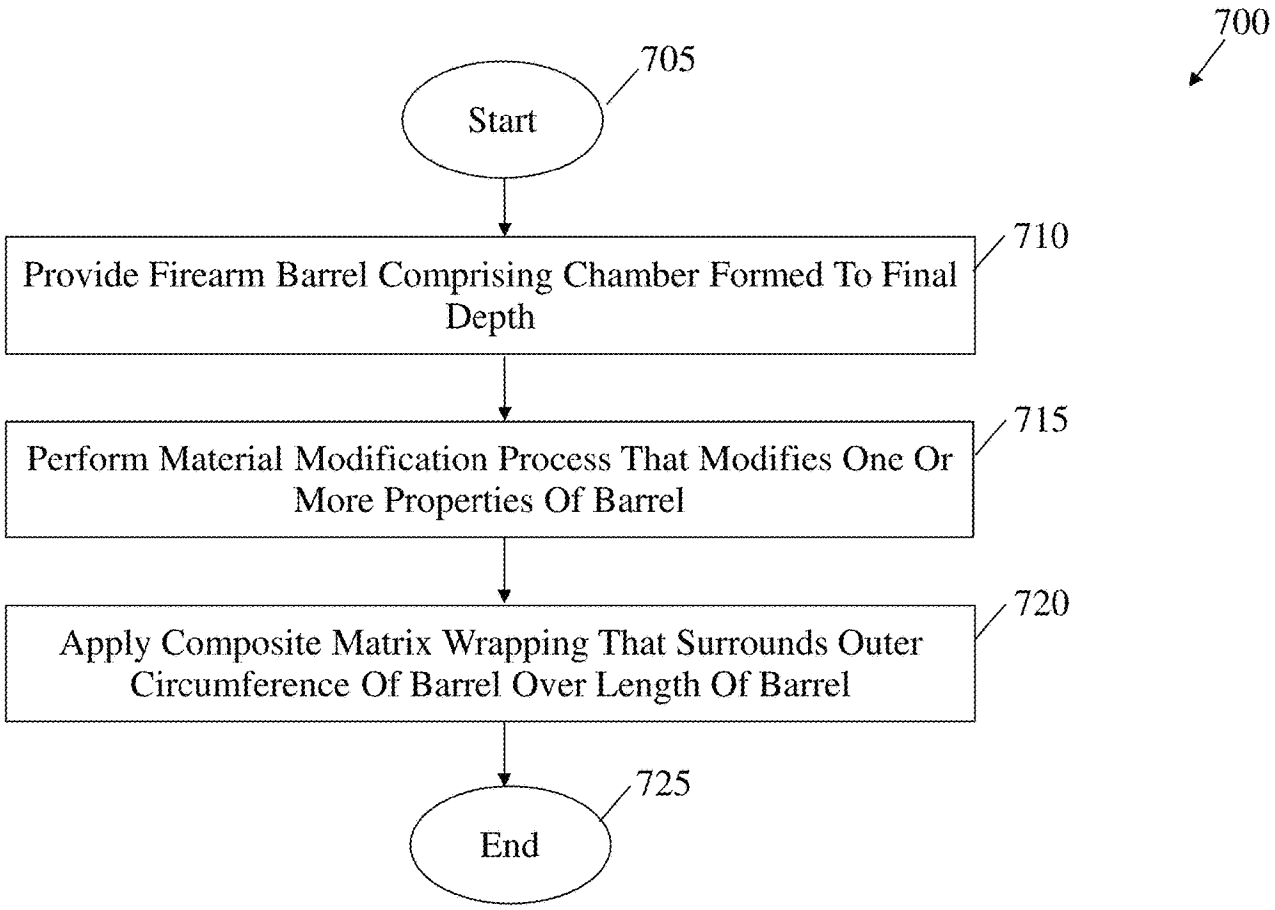
FIG. 7 illustrates an exemplary simplified procedure for manufacturing a firearm barrel according to embodiments of the present disclosure.

FIG. 7 illustrates an exemplary simplified procedure for manufacturing a firearm barrel according to embodiments of the present disclosure. For example, the steps of procedure 700 may be executed by a firearms manufacturer, a barrel blank manufacturer, or any entity capable of performing the processing operations described herein, as would be appreciated by a person of ordinary skill in the art. The procedure 700 may start at step 705, and continues to step 710, where, as described in greater detail above, a barrel for a firearm may be provided. The barrel may include a chamber therein, whereby the entire geometry of the chamber is formed to a final depth. Once the chamber is formed to the final depth, no further material may be removed from the chamber geometry. The geometry of the chamber may include various sections such as, for example, a body, a shoulder, a neck, a throat, and a leade, each of which is formed to a final depth. In some embodiments, when the barrel is provided, the chamber may be formed over-deep so as to allow headspace in the barrel without processing the chamber. Doing so may facilitate the formation of a receiver interface onto a portion of the outer surface of the barrel. The receiver interface may be machined at various stages of barrel processing, as described above. Furthermore, the barrel may be provided in the form of a barrel blank, in some embodiments.

At step 715, as detailed above, after the barrel is provided, whereby the entire geometry of the barrel's chamber is formed to the final depth, a material modification process that modifies one or more properties of the barrel may be performed. The material modification process may be applied to the barrel so as to harden or stiffen the material of barrel, in order to improve the useful life of the chamber sections (e.g., throat, leade, bore, etc.) during repeated firing of the firearm. In some embodiments, the material modification process may include a heat treatment, such as hot isostatic pressing, that is applied to the barrel. In other embodiments, the material modification process may include a case hardening treatment, such as gas nitriding, that is applied to the barrel. In yet other embodiments, the material modification process may include oxide coating applied to the barrel. Each of these examples of a material modification process are intended to modify a material property of the barrel, typically by hardening or stiffening the steel of the barrel core, for example, which in turns extends the useful life of the barrel.

At step 720, as detailed above, after the material modification process is performed, a composite matrix wrapping that surrounds an outer circumference of the barrel over a length of the barrel may be applied. The barrel may be wrapped with the composite matrix wrapping so as to reduce the weight of the barrel, resulting in a lighter-weight firearm. In some embodiments, the composite matrix wrapping may consist of, for example, carbon fiber reinforced polymer (CFRP) or other composite material. As described above, after the composite matrix wrapping is applied, additional processing operations to the exterior of the barrel may be performed as necessary to prepare the barrel for firing—without impacting the inner geometry of the chamber, which has already been formed to the final depth. These additional processing operations may include, for example, bonding operations that improve the adherence of the wrapping to the outer surface of the barrel, branding or caliber markings, and formation of the receiver interface, just to name a few.

It should be noted that while certain steps within procedure 700 may be optional as described above, the steps shown in FIG. 7 are merely examples for illustration, and certain other steps may be included or excluded as desired. Further, while a particular order of the steps is shown, this ordering is merely illustrative, and any suitable arrangement of the steps may be utilized without departing from the scope of the embodiments herein.

Accordingly, the firearm barrel disclosed herein is both lightweight and capable of withstanding a greater number of firings without noticeable loss of accuracy, resulting in an extended useful life. Although material modification processes, such as case hardening/heat treatments, and composite matrix wrappings, such as carbon fiber wraps, are typically incompatible with one another, the techniques disclosed herein allow for both processes—and most importantly their accompanying benefits—to be performed upon a single firearm barrel by ensuring the chamber of the barrel is formed to a final depth before either of the above processes is performed.

While there have been shown and described illustrative embodiments that provide for a lightweight barrel having an extended useful life, it is to be understood that various other adaptations and modifications may be made within the spirit and scope of the embodiments herein. Thus, the embodiments may be modified in any suitable manner in accordance with the scope of the present claims.

The foregoing description has been directed to embodiments of the present disclosure. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A method for manufacturing a firearm barrel, the method comprising:

providing a barrel for a firearm;

forming, within the barrel, a chamber configured to hold an ammunition cartridge, wherein an entire geometry of the chamber, including an interior of the chamber, is formed to a final depth within the barrel through the forming;

after forming the chamber within the barrel with the entire geometry of the chamber being formed to the final depth, performing a material modification process that modifies one or more metallurgical properties of the barrel, wherein no further material is cut away from the interior of the chamber by machining after the material modification process is complete;

after performing the material modification process, applying a composite matrix wrapping that surrounds an outer circumference of the barrel over a length of the barrel; and after the composite matrix wrapping is applied, processing the barrel so as to form a receiver interface onto a portion of an outer surface of the barrel, the receiver interface at least partially overlapping the chamber in a transverse direction.

2. The method of claim 1, wherein the barrel is formed within an over-deep chamber to enable the barrel to undergo any additional exterior machining operations after the material modification process and the composite matrix wrapping without cutting further material away from the interior of the chamber.

3. The method of claim 1, wherein the material modification process comprises a heat treatment that is applied to the barrel.

4. The method of claim 3, wherein the heat treatment comprises a hot isostatic pressing process.

5. The method of claim 1, wherein the material modification process comprises a case hardening treatment that is applied to the barrel.

6. The method of claim 5, wherein the case hardening treatment comprises a gas nitriding process.

7. The method of claim 1, wherein the material modification process comprises an oxide coating applied to the barrel.

8. The method of claim 1, wherein the composite matrix wrapping comprises carbon fiber reinforced polymer (CFRP).

9. The method of claim 1, wherein the providing of the barrel comprises:

processing the barrel so as to form the chamber in an interior portion of the barrel.

10. The method of claim 1, wherein the entire geometry of the chamber comprises a plurality of chamber features including two or more of: a body of the chamber, a shoulder of the chamber, a neck of the chamber, a throat of the chamber, and a leade of the chamber.

11. The method of claim 1, wherein, when the barrel is provided, the final depth of the chamber is formed over-deep so as to allow headspace in the barrel without processing the chamber.

12. The method of claim 1, wherein the barrel is processed so as to form the receiver interface before the material modification process is performed.

13. The method of claim 1, further comprising:

after applying the composite matrix wrapping, performing one or more additional processing operations to the barrel, wherein the one or more additional processing operations do not affect the entire geometry of the chamber which is formed to the final depth.

14. A firearm barrel comprising:

a barrel having a chamber formed therein configured to hold an ammunition cartridge, the chamber comprising an interior, the chamber extending longitudinally through an interior portion of the barrel, and one or more metallurgical properties of the barrel being modified by a material modification process that is performed on the barrel after the chamber is formed, wherein no further material is cut away from the interior of the chamber by machining after the material modification process is complete, and a receiver interface formed onto a portion of an outer surface of the barrel, the receiver interface at least partially overlapping the chamber in a transverse direction; and a composite matrix wrapping that surrounds an outer circumference of the barrel over a length of the barrel, wherein the composite matrix wrapping is applied to the barrel after the material modification process is performed, wherein an entire geometry of the chamber is formed to a final depth prior to the material modification process being performed, wherein the barrel is processed so as to form the receiver interface after the composite matrix wrapping is applied.

15. The firearm barrel of claim 14, wherein the material modification process comprises a heat treatment that is applied to the barrel.

16. The firearm barrel of claim 14, wherein the material modification process comprises a case hardening treatment that is applied to the barrel.

17. The firearm barrel of claim 14, wherein the material modification process comprises an oxide coating applied to the barrel.

18. The firearm barrel of claim 14, wherein the composite matrix wrapping comprises carbon fiber reinforced polymer (CFRP).

* * * * *